US008597066B2

(12) United States Patent
Grez

(10) Patent No.: US 8,597,066 B2
(45) Date of Patent: Dec. 3, 2013

(54) LIGHTWEIGHT OUTBOARD ELECTRIC MOTOR SYSTEM

(76) Inventor: Joseph W. Grez, North Bend, WA (US)

( * ) Notice: Subject to any disclaimer, the term of this patent is extended or adjusted under 35 U.S.C. 154(b) by 136 days.

(21) Appl. No.: 13/230,810

(22) Filed: Sep. 12, 2011

(65) Prior Publication Data

US 2012/0064783 A1 Mar. 15, 2012

Related U.S. Application Data

(60) Provisional application No. 61/381,490, filed on Sep. 10, 2010.

(51) Int. Cl.
*B63H 21/17* (2006.01)
*B63H 20/32* (2006.01)

(52) U.S. Cl.
USPC ..... 440/6; 440/78

(58) Field of Classification Search
USPC ..... 440/75, 6, 78, 83
See application file for complete search history.

(56) References Cited

U.S. PATENT DOCUMENTS

| | | | | |
|---|---|---|---|---|
| 4,099,478 | A * | 7/1978 | Alexander, Jr. | 440/6 |
| 5,439,401 | A * | 8/1995 | Clark | 440/6 |
| 5,453,030 | A * | 9/1995 | Broussard | 440/6 |
| 5,509,835 | A * | 4/1996 | Henderson et al. | 440/63 |
| 2001/0029133 | A1 * | 10/2001 | Breems | 440/6 |
| 2008/0085641 | A1 * | 4/2008 | Williams | 440/6 |

* cited by examiner

*Primary Examiner* — Stephen Avila
(74) *Attorney, Agent, or Firm* — Dean A. Craine

(57) ABSTRACT

An outboard electric motor kit that includes an electric motor assembly with a unitized propeller hub, a transom mount, a rechargeable electric battery, and an optional recharger. The assembly includes an electric motor unit located in an upper housing. A lower tube stem is attached and that extends downward from the upper housing to a lower housing. Formed on the lower housing is a receiving cavity with a rearward facing propeller hub opening. A drive shaft coupled to the motor unit extends downward inside the lower tube stem and mounted to a gear support block located in the receiving cavity. Mounted on the end of the drive shaft is a main gear. Mounted on the gear support block is a fixed axle that extends coaxially aligned through the propeller hub opening. Extended through the opening and coaxially mounted over the fixed axle is a removable propeller hub assembly.

19 Claims, 17 Drawing Sheets

LIGHTWEIGHT OUTBOARD ELECTRIC MOTOR SYSTEM

This utility patent application is based on and claims the filing date benefit of U.S. provisional patent application (Application No. 61/381,490) filed on Sep. 10, 2010.

COPYRIGHT NOTICE

Notice is hereby given that the following patent document contains original material which is subject to copyright protection. The copyright owner has no objection to the facsimile or digital download reproduction of all or part of the patent document, but otherwise reserves all copyrights whatsoever.

BACKGROUND OF THE INVENTION

1. Field of the Invention

This invention relates to outboard electric motors for boats, and more particularly to such outboard electric motors that are lightweight, portable and require little or no maintenance.

2. Description of the Related Art

Operators of oar driven small boats, such as dinghies, canoes, kayaks and inflatable watercraft, find it sometimes desirable to propel their boats using an electric motor. Ideally, the electric motors and their batteries should be sufficiently lightweight to they may manually carried and adaptable or attachment to different transoms or transom bars.

Typical outboard electric motors on small boats consist of direct drive motor units mounted inside a submerged housing. Such outboard electric motors use relatively small propellers that measures 5 to 11 inches in diameter. While such propellers are relatively small and inefficient at speeds under 10 mph, the higher RPM and torque requirements of large propellers make them unsuitable for direct drive electric motors. In addition, because the drive motor units are submerged, leaks around the housing is a failure point.

There are two types of gear systems used with outboard electric motors—sealed gear systems in which the gears and bearings lubricated with grease are used to rotate a propeller are all located in a watertight, sealed housing; and non-sealed gear systems in which the gears and bearings are located in a non-watertight housing in which water flows and in direct contact with the gears and bearings and acts as a lubricant.

One drawback with watertight, sealed gear systems is that the gears and bearings must periodically cleaned and regreased. Another drawback is that the watertight, sealed system is that the watertight housing can fail allowing water or moisture to enter and damage the gears and bearings.

One drawback with non-watertight gear systems is that water has lower lubricating properties than grease making the gears and bearings vulnerable to greater wear and corrosion. As a result, the gears and bearings used in non-watertight gear systems must be replaced more often which heretofore has been more expensive and time consuming than lubricating the gears and bearings in watertight, sealed systems.

Many small boats with electric motors are operated in small bodies of water that are shallow and require the small boat to be run aground on the beach to load and unload. As a result, the motor's lower shaft and propeller often contact submerged objects or the ground. To prevent damage to the lower shaft or propeller, the mounting system used to mount the electric motor must either allow the user to selectively swing the electric motor out of the water or allow the lower shaft to freely swing upward when impacting submerged objects.

Some small boats, such as dinghies and kayaks, have built in transoms upon which an electric motor can be mounted. Some small boats, such as canoes, do not have transoms and therefore require a secondary transom plate adaptor mounted on the side of the boat upon which an electric motor can be mounted. Because the angle of the transoms or the transom plates can vary, the transom mount used with outboard electric motors must be adjustable for different transom angles.

U.S. Coast Guard regulations require that batteries used with outboard electric motors be securely attached at a fixed location inside the boat. Heretofore, secondary straps and buckles have been used to attach the batteries directly to a boat surface. Unfortunately, not all small boats have battery straps or buckles or surfaces for affixing a battery. In addition to holding the battery in a fixed location inside the boat, attaching the batteries to the boat is especially important because small boats can easily overturn in the water causing all non-buoyant objects, such as an electric batteries to be lost.

SUMMARY OF THE INVENTION

In summary, the invention is an outboard electric motor kit that includes a lightweight, portable electric motor assembly designed to be used with small boats and lightweight rechargeable battery to supply electric current to the electric motor. The electric motor assembly includes upper housing that extends above the boat's transom or temporary transom plate. Located inside the upper housing is an electric motor unit. Attached to and extending down from the upper housing is a lower stem shaft. Connected or formed on the lower end of the lower stem shaft is a lower housing.

A key aspect of the invention is the discovery that the use of relatively inexpensive, replaceable gears in non-watertight housings that uses water as a lubricate is preferable over watertight housings found in the prior art that use more expensive gears and must be lubricated with grease.

To implement this discovery, the lower housing includes a receiving cavity with a rearward facing propeller hub opening. A drive shaft coupled at one end to the motor extends downward through the lower tube and into the lower housing's receiving cavity. The lower end of the drive shaft is held in the receiving cavity by a gear support block which is fixed in a stationary position inside the receiving cavity. Mounted on the section of the drive shaft above the gear support block and positioned within the receiving cavity is a main gear. Attached to the gear box and extending rearward from the receiving cavity is a fixed axle that is perpendicularly aligned with the drive shaft. The fixed axle extends rearward through the propeller hub opening on which a removable propeller hub assembly is mounted. The propeller hub assembly includes a secondary gear located therein and configured with teeth that are compatible and mesh with teeth on a main gear when the propeller hub assembly coaxially aligned over the fixed axle and inserted into the propeller hub opening and into the receiving cavity.

The propeller hub assembly and secondary gear are made of durable, lightweight inexpensive materials thereby making it more cost effective than watertight seal systems that typically use metallic gears and grease. During operation, water is able to flow into the receiving cavity and act as a lubricant. When servicing is needed, the entire propeller hub assembly may be easily removed from the fixed axle and replaced if necessary. If the main gear is damaged or worn, it too can be easily accessed and removed from the lower unit.

Mounted on the upper housing is a tiller arm that the user used to rotate and lift the electric motor assembly in the water. Mounted on the end of the tiller arm is a handle with an adjustable switch located therein that is electrically configured with the electric motor that enables the user to control the direction of the propeller's rotation and the rotation speed of the propeller. Also, mounted on the handle on the tiller arm is locking key slot that receives a locking key attached to a wrist band that activates the electric motor when inserted into the key slot and deactivates the electric motor when it is removed.

The outboard motor assembly may also include an adjustable transom mount that enables the electric motor assembly to be selectively attached to different transoms. The transom mount also enables the electric motor assembly to rotate freely side-to-side over its longitudinal axis. The transom mount also allows the entire electric motor assembly to rotated forward over the transom thereby lifting the lower shaft and lower housing out of the water.

More specifically, the transom mount includes two parallel side plates that are independently clamped to the transom and pivotally connected via an upper main bolt and a block member. The block member includes at least one longitudinally aligned pin that extends from each end of the block member and slides over a diagonally aligned ratchet slot formed on each side plate. Each ratchet slot includes a plurality of downward oriented pin slots that are longitudinally aligned in an offset angle to the line that extends from the forward edge of the ratchet slot opposite a pin slot to the longitudinal axis of the main bolt. In one embodiment, the block member is a rotating structure with two opposite spacer blocks and an intermediate narrow neck designed to roll over the front surface of a guide collar that connects to the motor's lower drive stem. During use, the upper housing must be manually lifted so that the pin may move from one set of slot pins to another set of slot pins on the ratchet slot to re-adjust the angle of the motor on the transom.

The electric motor assembly is distributed with a fast, rechargeable electric battery. The electric battery is watertight and includes means that enable the battery and the bag to float if accidentally dropped in the water. A locking pin is provided that enables the user to securely attaches the battery bag directly to the transom mount. An optional fast battery charger is also included in the kit.

DESCRIPTION OF THE PREFERRED EMBODIMENT(S)

Figure 1:
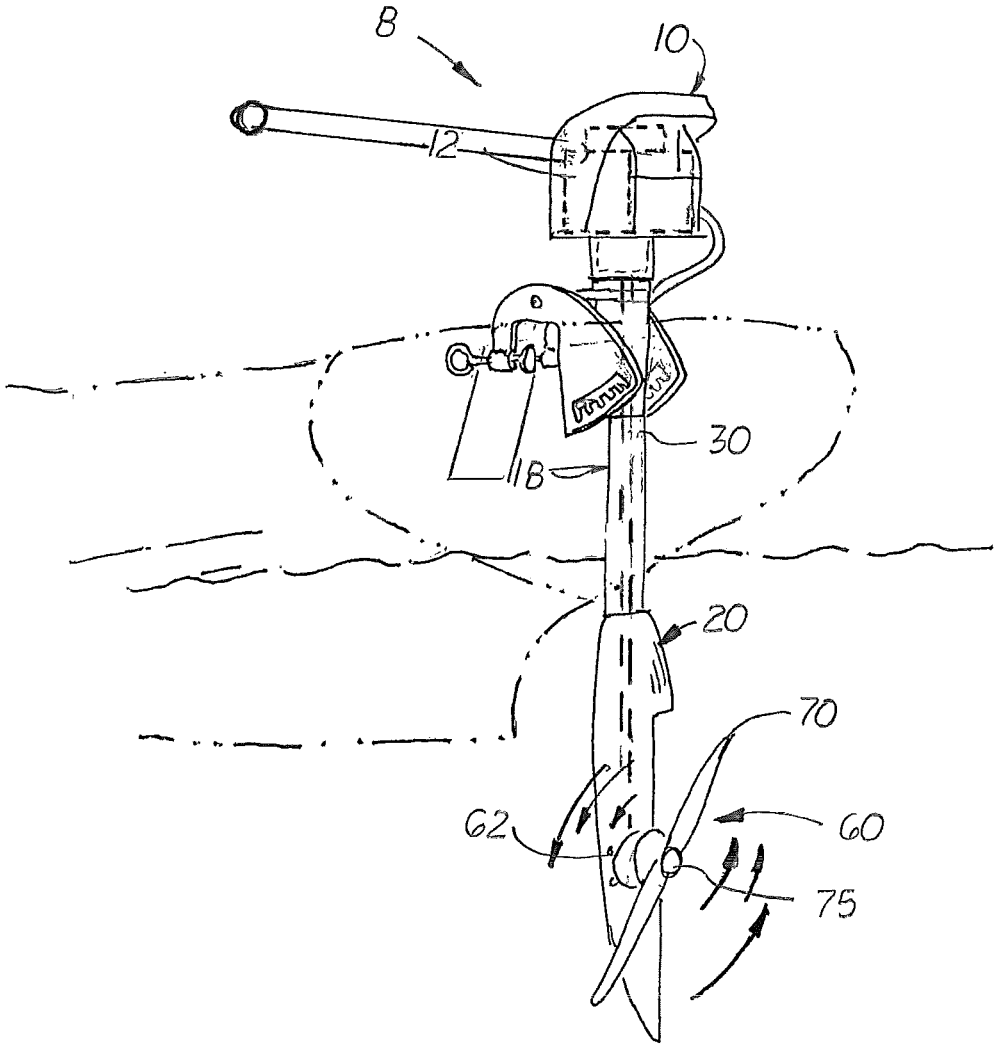
FIG. 1 is a rear perspective view of the transom on a small watercraft with an outboard motor that includes the replacement propeller module attached thereto.

Referring to the accompanying Figs. there is shown an outboard electric motor assembly generally indicated by the reference number 8. The electric motor assembly 8 includes an electric motor 12 located in an upper housing 10. Attach and extending downward from the upper housing is a lower stem tube 18. Attached or integrally formed on the lower end of the lower stem tube 18 is a lower housing unit 20.

Figure 2:
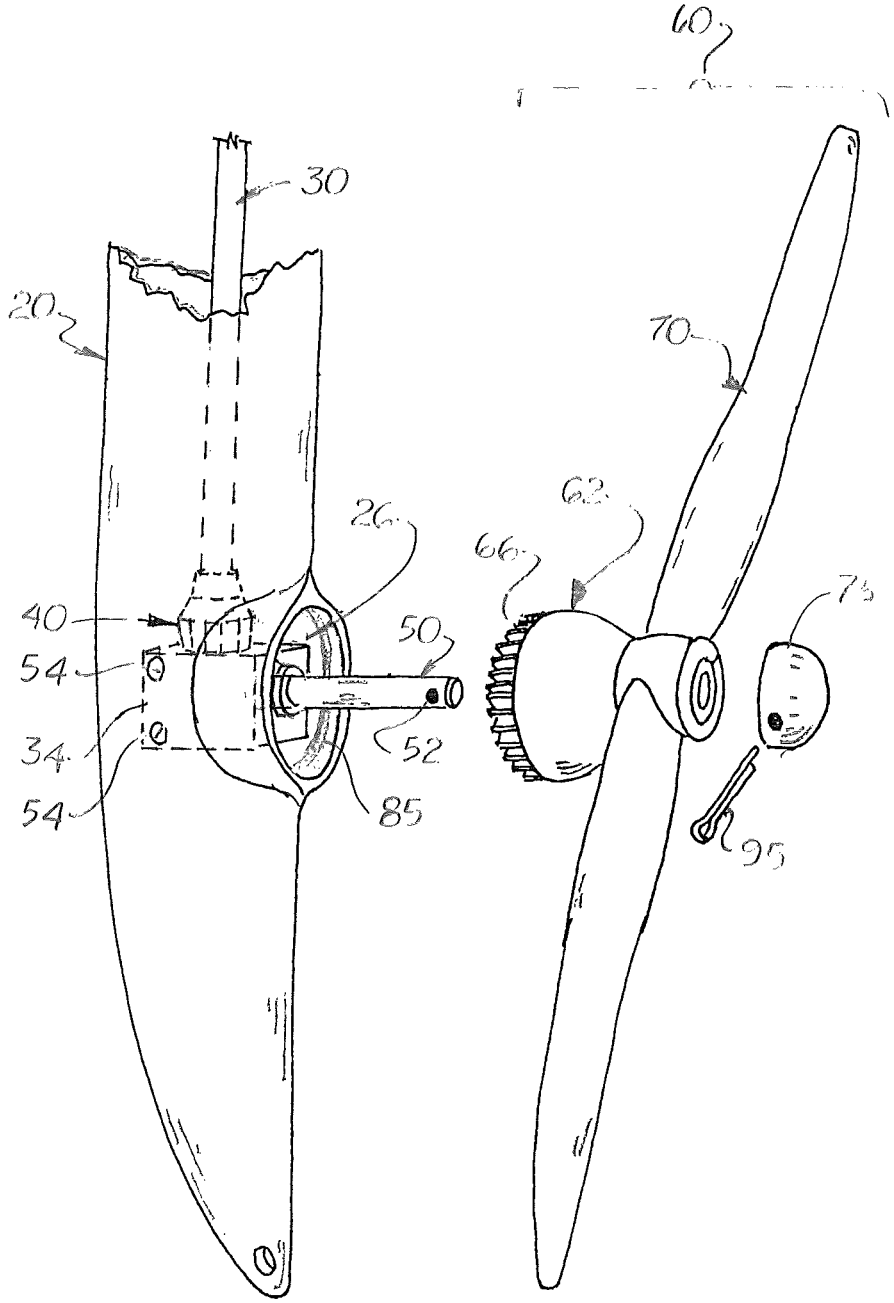
FIG. 2 is a perspective view of the lower propeller housing showing the propeller hub assembly detached therefrom.
Figure 3:
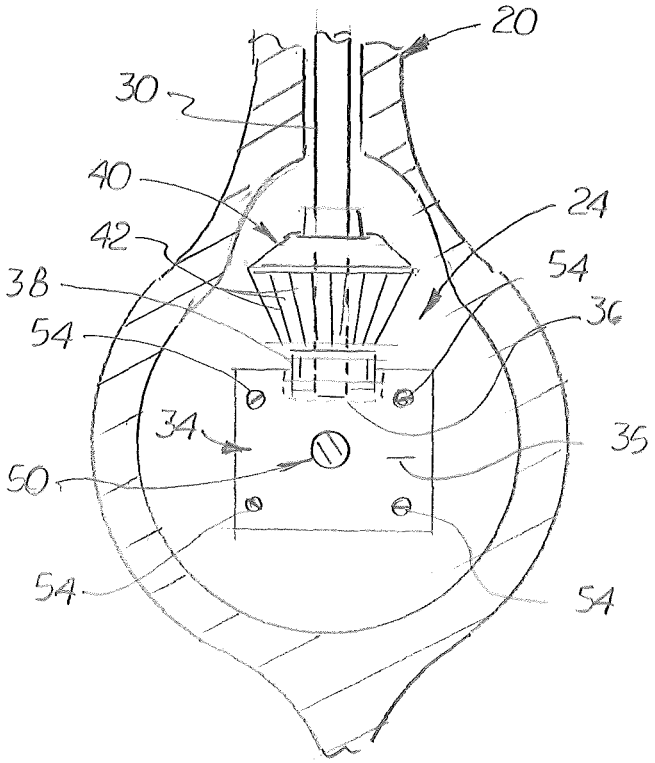
FIG. 3 is a rear elevational view of the lower housing showing the receiving cavity with the gear box and distal end of the drive shaft attached to the gear box.
Figure 4:
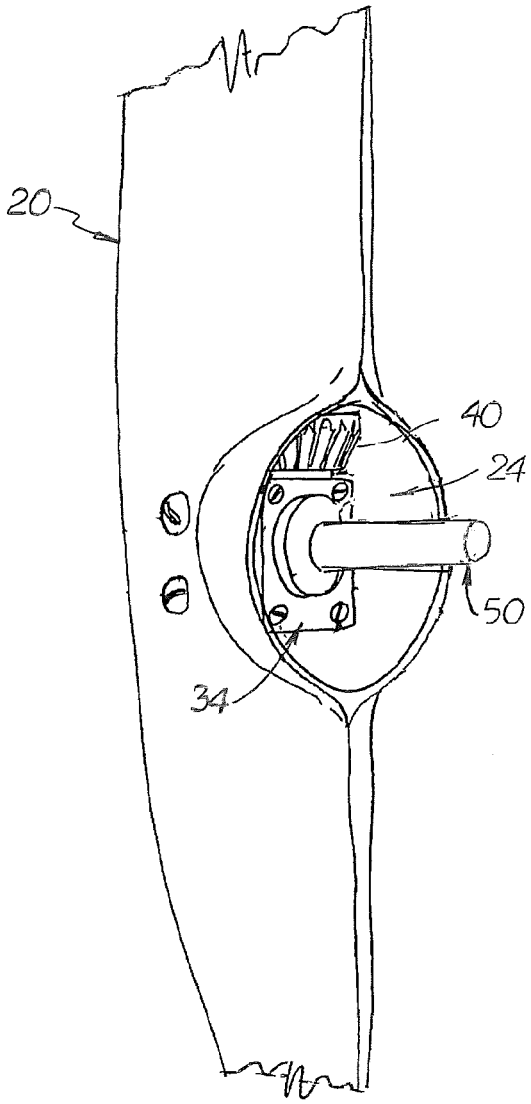
FIG. 4 is a perspective view of the lower propeller housing with the propeller hub assembly removed.
Figure 5:
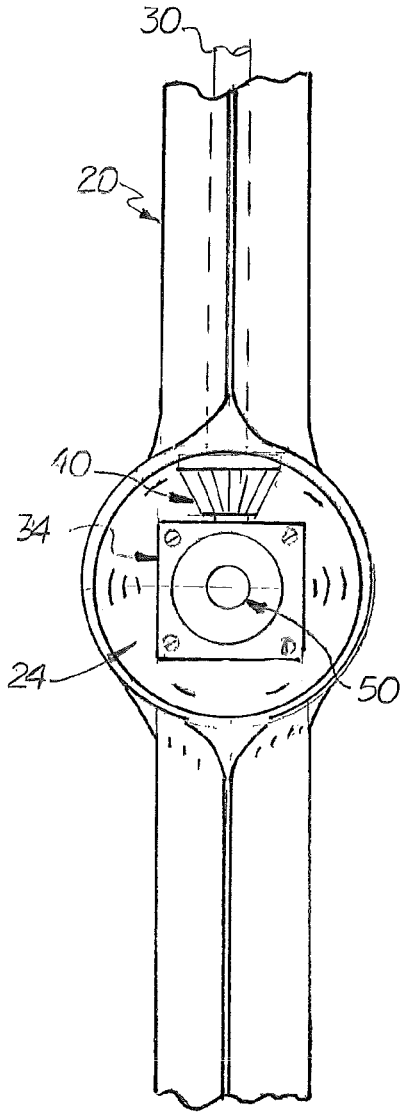
FIG. 5 is a rear elevational view of the lower housing unit shown in FIG. 4.

As shown in FIGS. 2 and 3, formed on the lower housing unit 20 is a receiving cavity 24 with a rearward facing circular opening 26. A drive shaft 30 is coupled at one end to the electric motor and extends downward through the lower stem tube 18 and into the receiving cavity 24. Located inside the receiving cavity 24 is a gear support block 34. The gear support block 34 is fixed inside the receiving cavity 24 and includes an upper bore 36 with a bearing 38 located therein. The distal end of the drive shaft 30 is connected to the bearing 38 thereby enabling it to rotate freely over the top surface of the gear support block 34. Screws 54 extend through the sides of the lower housing unit 20 or through the rear surface of the gear support block 34 and into the inside surface of the receiving cavity 24 to hold the gear support block 34 in place therein. It should be understood that the gear support block 34 may be secured any suitable connectors.

Attached to the section of the drive shaft 30 located above the gear support box 34 is a main gear 40 with a plurality of teeth 42 designed to mesh with teeth 67 formed on the secondary gear 66 coupled to the propeller.

The receiving cavity 24 includes a rearward propeller hub opening 26. Attached to the rear surface 35 of the gear support block 34 and extending rearward through the hub opening 26 is a coaxially aligned fixed axle 50. The fixed axle 50 is attached to the rear surface of the gear support block 34 and is perpendicular to the drive shaft 30. In different embodiments, the distal end of the fixed axle 50 includes a cotter pin hole 55 or threaded neck 56. Coaxially aligned over the fixed drive shaft 50 and against the outside surface of the gear support block 34 is a flat washer 53.

Coaxially aligned and extending into the hub opening 26 is a removable propeller hub assembly 60 which mounts on the fixed axle 50. The propeller hub assembly 60 includes a propeller hub 62 designed to partially fit into the circular opening 26, a replaceable secondary gear 66, a propeller 70 and a removable cap 75. The propeller hub 62 is a half-spherical structure with a circular cross-section that enables it to fit snuggly inside the hub opening 26 formed on the lower housing unit 20.

Figure 7:
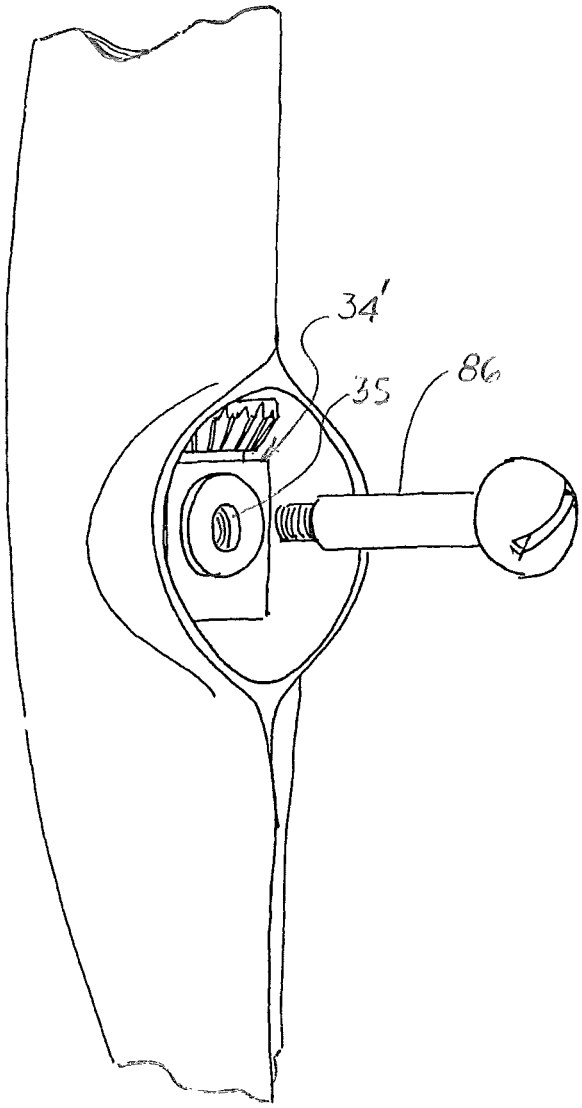
FIG. 7 is a perspective view of the lower housing unit in which the fixed axle is replaced by a removable threaded screw that holds the propeller hub assembly in place.
Figure 8:
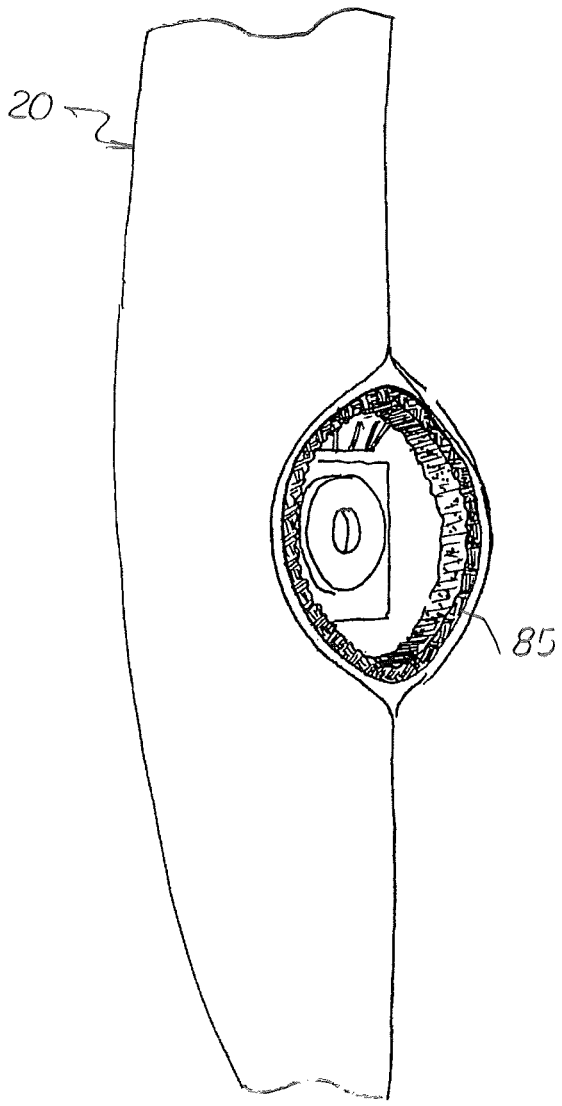
FIG. 8 is a perspective view of the lower housing unit showing an optional seal located around the inside edge of the cavity.

As shown in FIGS. 2 and 7, a felt ring 85 may be attached to the inside surface of the circular opening 26 which acts as a filter to prevent these more damaging materials from entering the recessed cavity 24 when the propeller hub 62 is inserted into the circular opening 26.

Figure 9:
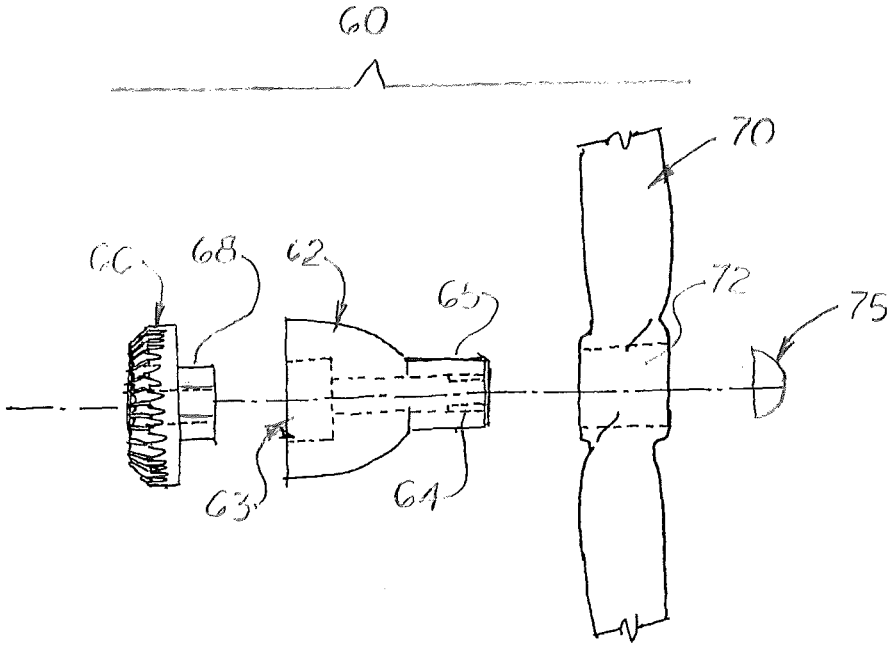
FIG. 9 is a side elevational view of the propeller hub assembly.

As stated above, the fixed axle 50 is stationary and acts as a combination mounting and aligning structure for the propeller hub 62 and the secondary gear 66. In the embodiments shown in FIG. 9, the propeller hub 62 includes internal bearings 64 that coaxially align the propeller hub 62 over the fixed axle 50. Disposed on the inside surface of the propeller hub 62 is a secondary gear 66 that includes a longitudinally aligned neck 68 that fits into a counter-bore 63 formed on the inside surface of the propeller hub 62. The counter-bore 63 and neck 68 are 'keyed' and have compatible shapes so that the propeller hub 60 and the secondary gear 66 are interconnected and are rotatably locked together. Alternatively, it should be understood that the secondary gear 66 and the propeller hub 62 may be a single structure with the secondary gear 66 adhesively attached or integrally formed on the inside surface of the propeller hub 62. With all the embodiments, removal and replacement of the propeller hub 62 and the secondary gear 66 may be done simultaneously.

Figure 6:
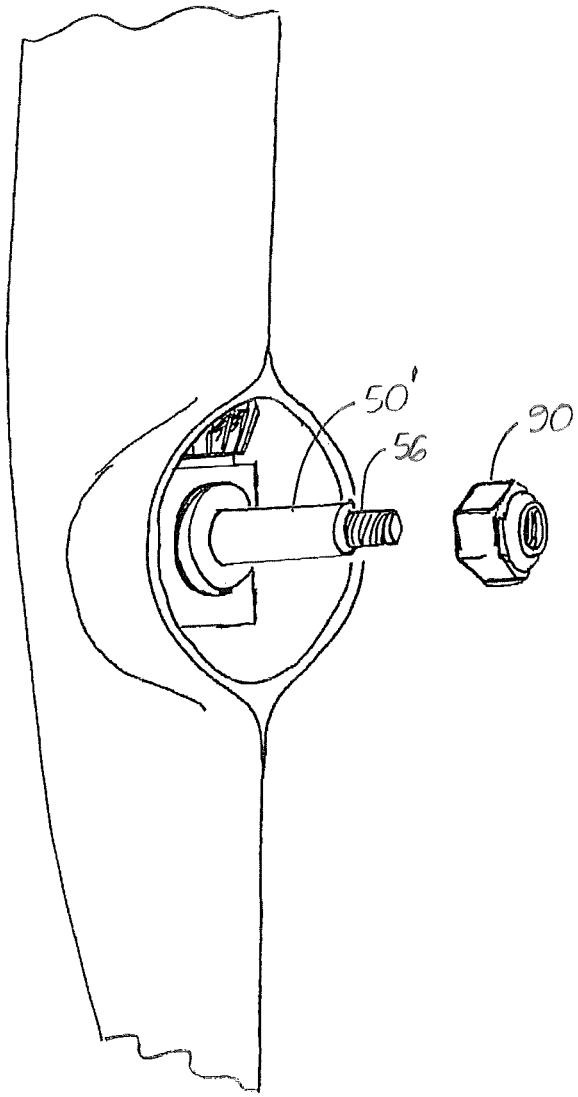
FIG. 6 is a perspective view of the lower housing unit in which the fixed axle includes a threaded neck that connects to a nut to hold the propeller hub assembly in place.

In the embodiment show in FIG. 2, the propeller hub 62 is secured to the fixed axle 50 by a cotter pin 95 that extends through a bearing cap 75 and a hole 52 formed on the distal end of the fixed axle 50. In another embodiment shown in FIG. 6, the fixed axle 50 is replaced by a second fixed axle 50' with a threaded neck 56 that connects and a threaded nut 90. In FIG. 7, a shoulder screw 86 is used in place of the first and second axles 50, 50' and the cap 75 and nut 90. When a shoulder screw 86 is used, a modified gear block 34' is used with a threaded bore 35 that attached to the shoulder screw 86.

In one embodiment, the main gear 40 is made of more durable material than the secondary gear 66 causing the replaceable secondary gear 66 to preferentially wear or fail sooner than the main gear 40. In this embodiment, the main gear 40 is of stainless steel and approximately 1 inch in diameter, the fixed axle 50 or 50' is also of stainless steel and 5/16 inch in diameter. The bearing 34 for the main shaft 50 is PEEK and held within a removable gear block 52 that measured approximately 0.75" wide by 1.5 inches deep and 1 inch high. The gear block 52 is secured using ¼-20 stainless steel screws through the lower housing unit 20. As shown in FIG. 3, the fixed axle 50, 50' has a ⅛ inch crosswise hole through its end through which a ⅛ inch diameter×1 inch cotter pin 95 is pressed in conjunction with a 1 inch diameter bearing cap 75. The propeller 70 is made up of a 13.5 inch in diameter and made up of glass-filled nylon and the propeller hub 62 is approximately 2 inches in length and 1.5 inches in diameter. The secondary drive gear 66 is approximately 1 inch in length and 1.5 inches in diameter. The propeller assembly 60 is designed to be replaced in two minutes and the gear block 34 can be replaced in 5 minutes. Both can be accomplished using a screwdriver and pliers.

Figure 10:
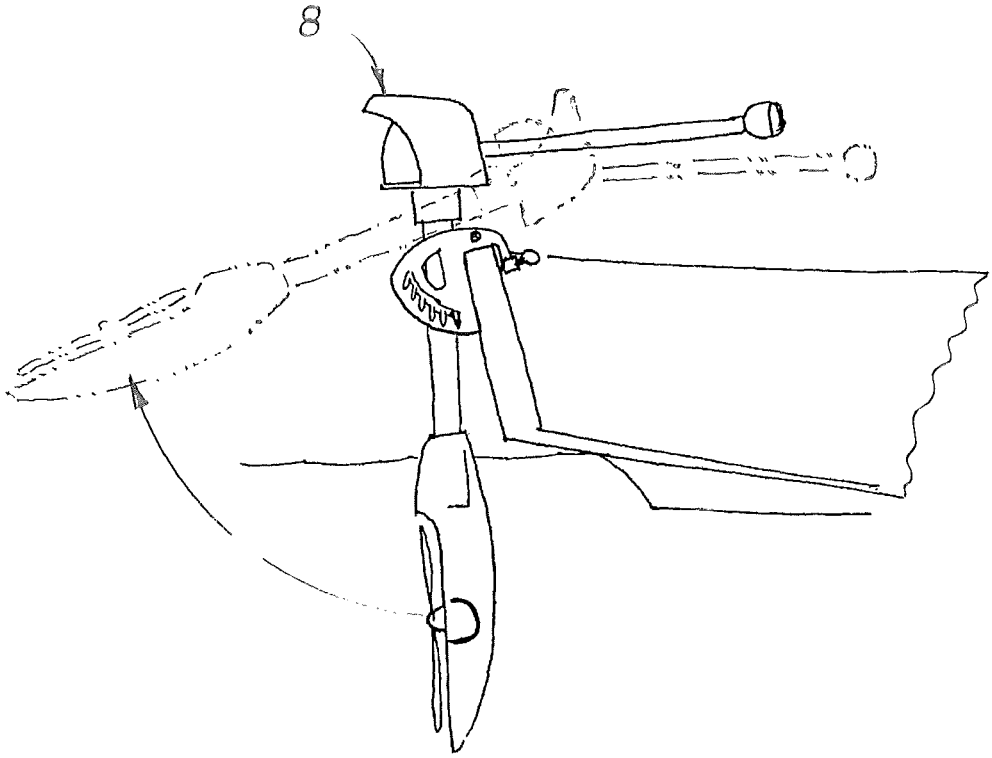
FIG. 10 is an illustration of an electric outboard motor attached to the transom of a boat by the angle adjustable mount disclosed herein.

The electric motor assembly includes an adjustable transom mount 100 used to reduce the amount of stress exerted on the mounts' main bolt 110 to reduce breakage or bending thereof and to prevent rotation of the motor 8 on the transom 6 when the motor 8 is reversed (see FIG. 10).

The adjustable transom mount 100 includes two parallel side plates 102, 102' pivotally connected via an upper main bolt 110 and a lower block member 140, 150. Each side plate 102, 102' includes a forward extending arm 104 with a screw clamp 106 attached to its distal end. Also formed on each side plate 102, 102' is a curved, diagonally aligned ratchet slot 130. The two slide plates 102, 102' are aligned in a parallel configuration and spaced apart and connected together by the main bolt 110.

Extending around the motor's lower tube 18 is a cylindrical shaped guide collar 114. Formed on the guide collar 114 is a forward extending arm 116 with a bore 118 through which the main bolt 110 extends.

Figure 11:
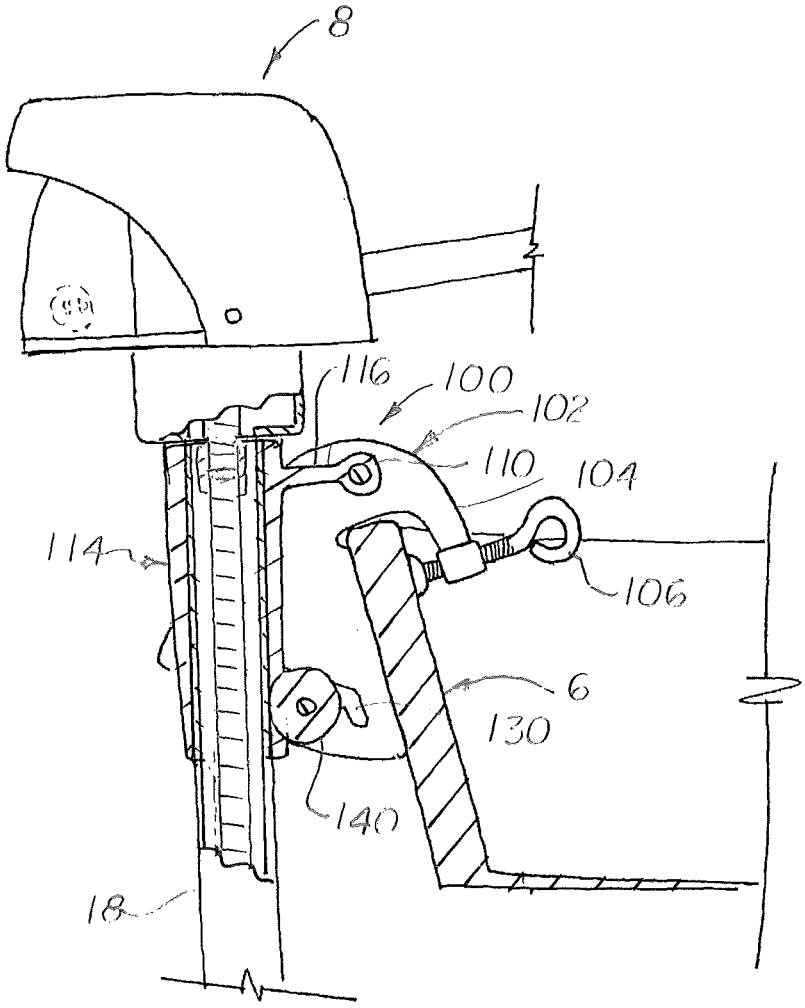
FIG. 11 is a partial side elevational view of the outboard motor and adjustable mount shown in FIG. 10.
Figure 12:
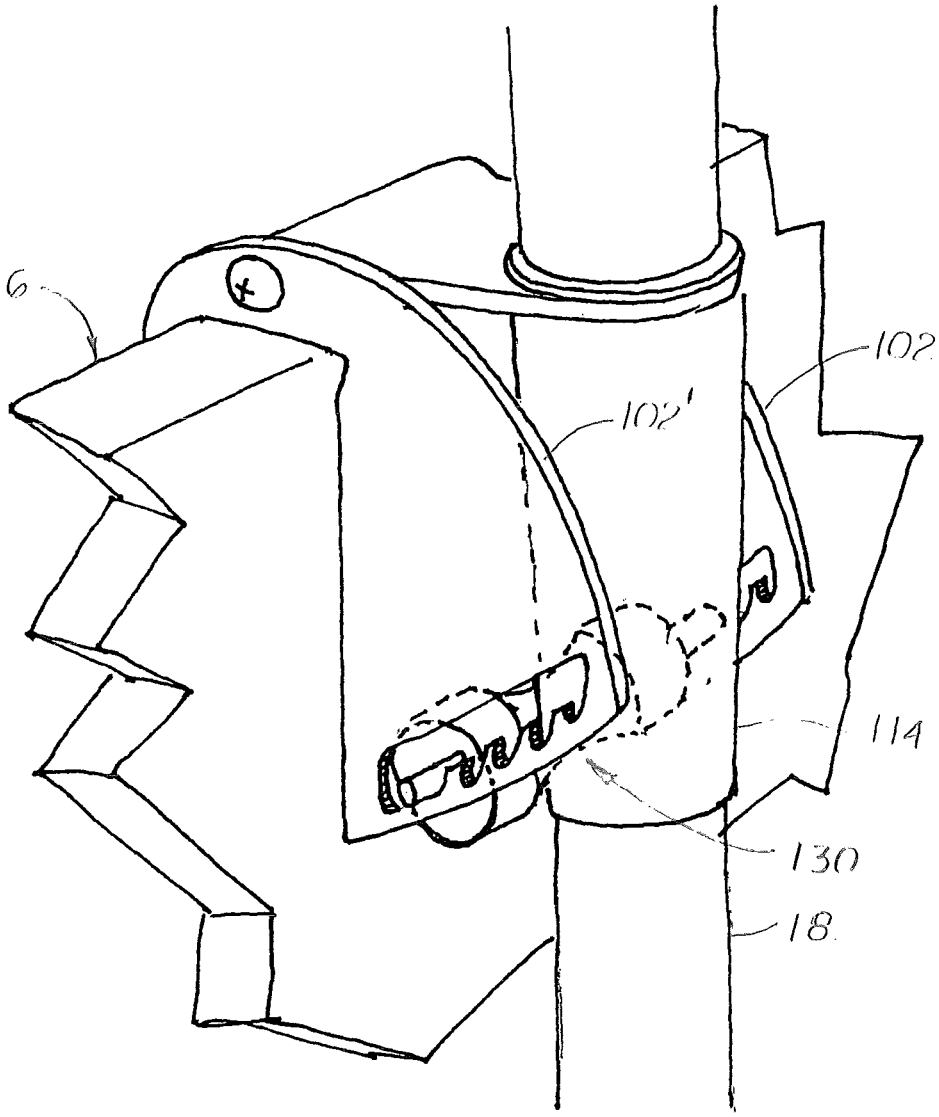
FIG. 12 is a perspective view of the adjustable mount.
Figure 13:
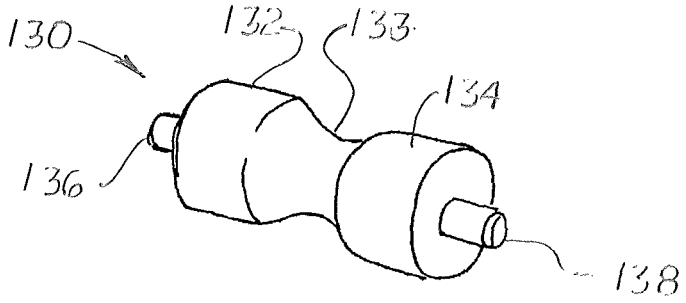
FIG. 13 is a perspective view of the rotating block member used in the mount shown in FIGS. 11 and 12.
Figure 14:
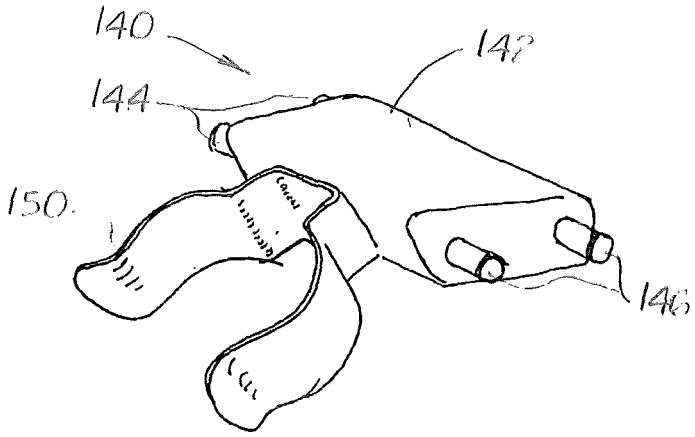
FIG. 14 is a perspective view of the fixed block member used to prevent rearward rotation of the motor step when the motor is reversed.

Located below the main bolt 110 and transversely aligned between the two side plates 102 is a block member 140, 150 includes at least one longitudinally aligned pin 136, 138, or 144, 146, respectively, that slides over the diagonally aligned ratchet slot 130 formed on each side plate 102, 102'. In one embodiment shown in FIGS. 11-13, the block member is a rotating with two opposite spacer blocks 132, 134 and an intermediate narrow neck 133 that rolls over the front surface of the motor's guide collar 114. In another embodiment shown in FIG. 14, the block member 140 is a rectangular fixed block with two pins 144, 146 that extend longitudinally from the block's opposite ends. The two pins 136, 138 or 144, 146 extend into the pin slots 132 formed on the ratchet slot 130. Attached to the rear surface of the fixed block member 140 is a U-shaped collar 150 that snaps onto the motor's guide collar 114 to securely hold the motor guide collar 114 and prevent its rearward rotation when the motor 8 is reversed.

Figure 15:
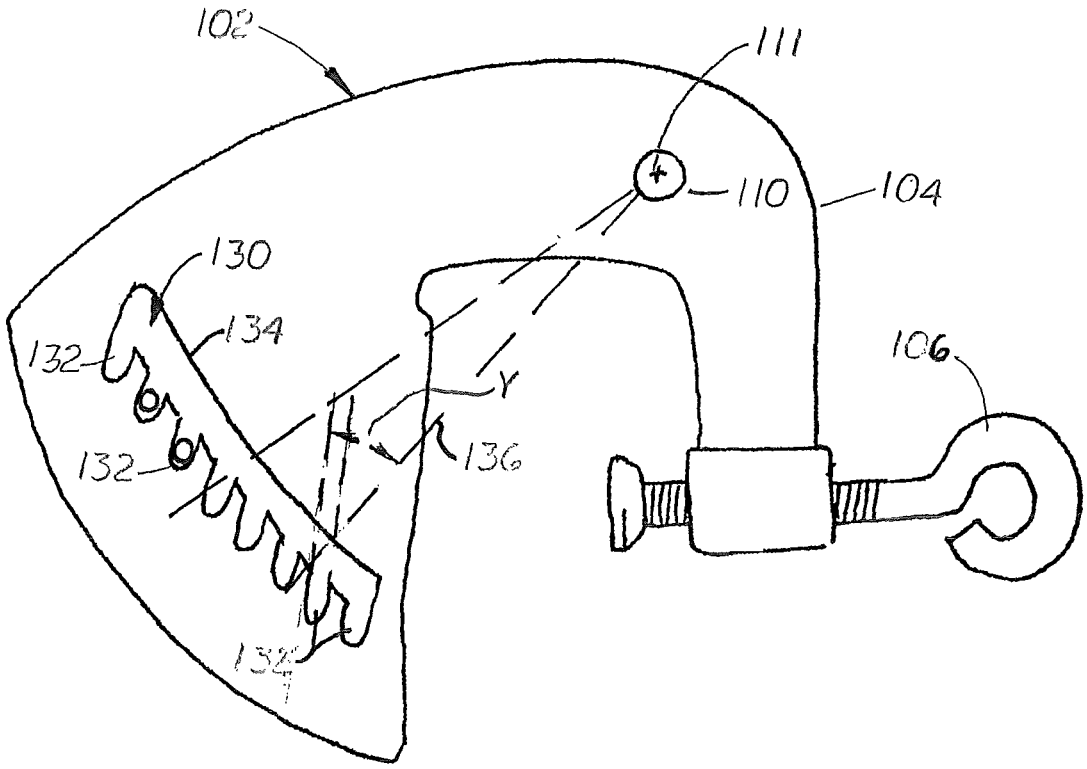
FIG. 15 is a side elevational view of a side plate showing the angular orientation of the pin slots formed on the rear edge of the ratchet slot with respect to the line that extends from the front edge of the ratchet slot opposite the pin slot to the main bolt.

As shown more clearly in FIG. 15, each ratchet slot 130 includes a plurality of downward oriented pin slots 132 that are longitudinally aligned in an offset angle to a line 136 that extends from the forward edge 134 of the ratchet slot 130 opposite a pin slot 132 to the longitudinal axis 111 of the main bolt 110.

Figure 16:
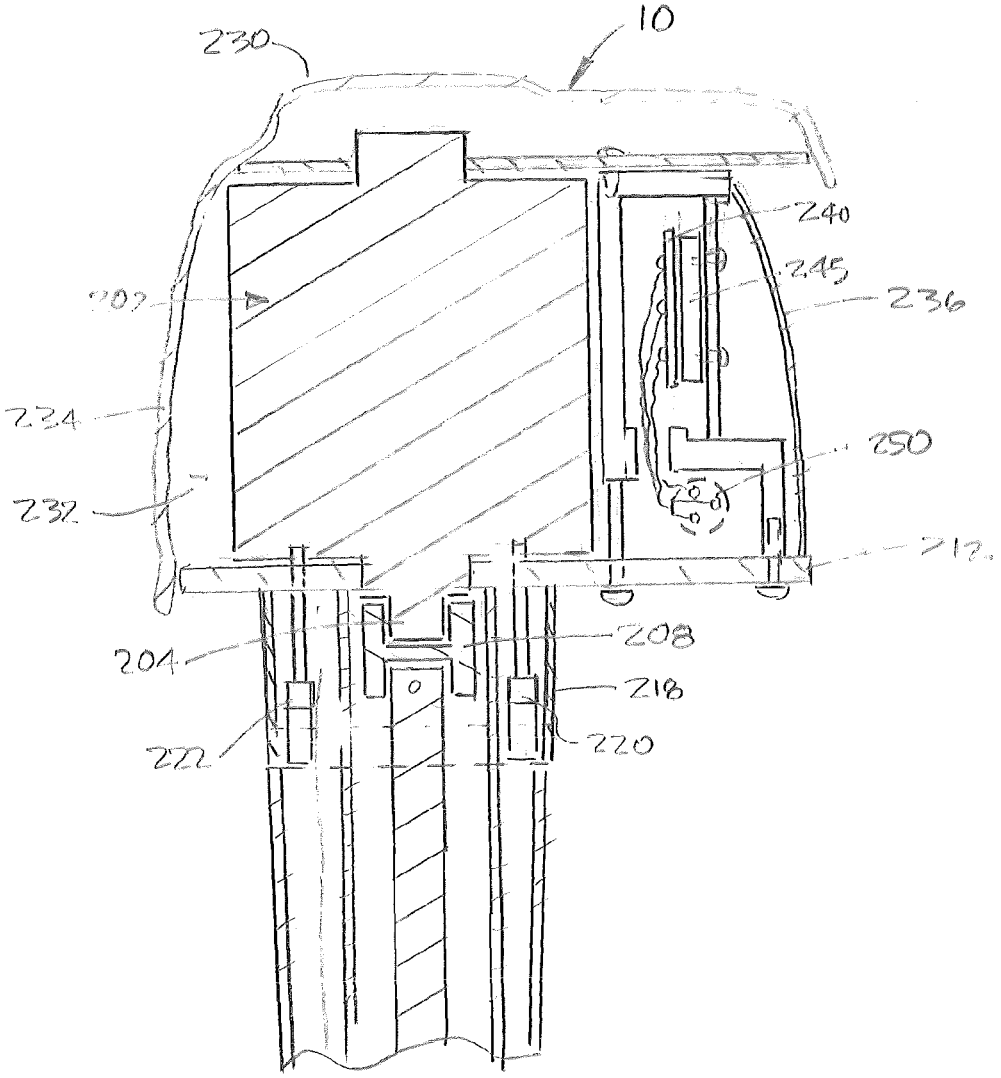
FIG. 16 is a sectional side elevational view of the upper housing and the motor unit located therein.

FIG. 16 is a sectional side elevational view of the upper housing 10 and a 24 volt electric motor 202 located therein. The electric motor 202 includes drive shaft stem 204 that is longitudinally aligned inside the stem tube. Mounted around the drive shaft stem 204 is a shaft coupler 208. Attached to the lower end of the shaft coupler 208 is the upper end of the main drive shaft. The electric motor 202 is mounted on a flat support plate 212 located inside the upper housing 10. Bolts 220, 222, extend through a mounting collar 218 located below the flat support plate 212 and connect to the bottom surface of the electric motor 202. The upper housing 10 includes a decorative top cowling 230, two side cowlings 232 (only one shown) a front cowling 234 and a rear cowling 236. Mounted inside the upper housing 10 and adjacent to the motor unit 202 is a printed circuit board (hereinafter called a PCB 240) with a heat sink 245. The PCB 240 is electrically connected to the motor unit 202 to the throttle switch and key switch in the handle discussed further below. The PCB 240 is also connected to a battery plug connector 250.

Figure 17:
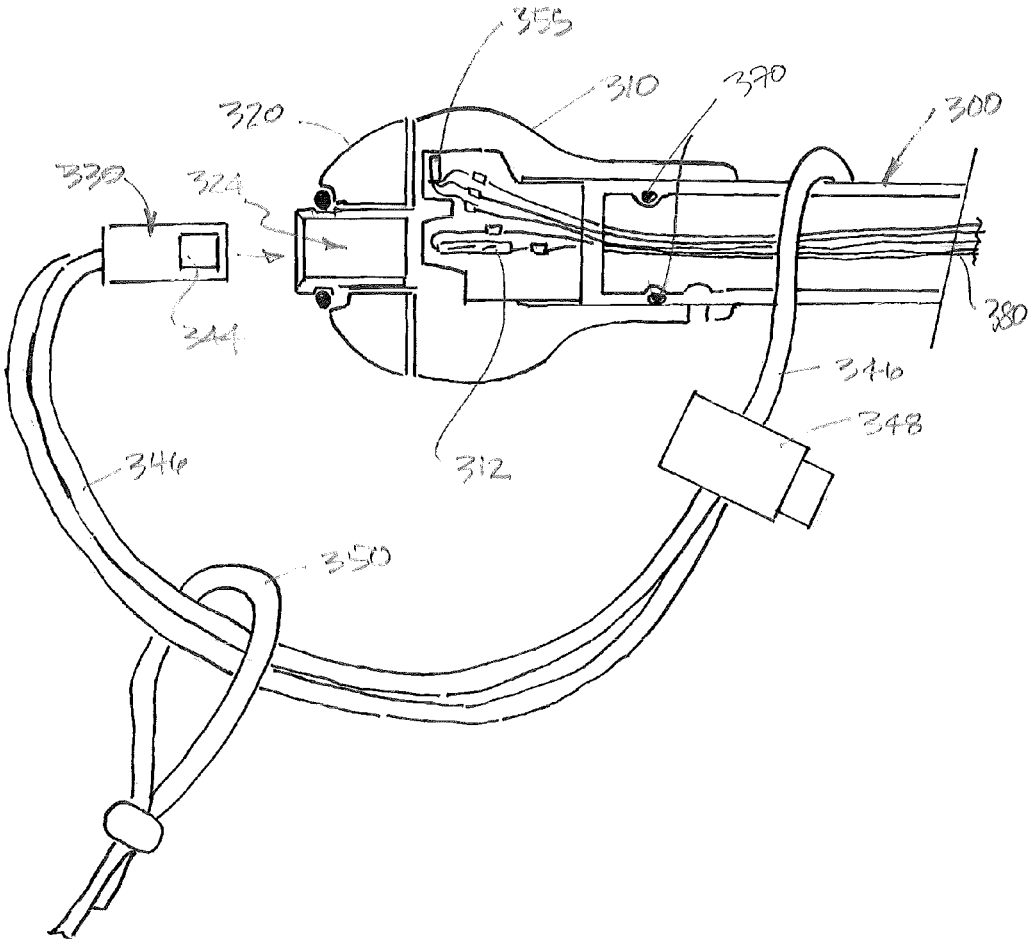
FIG. 17 is a sectional sided elevational view of the handle attached to the tiller arm with a rotating throttle knob mounted on the end of the handle with a key slot formed on the end of the handle and coaxially aligned with the throttle knob that receives a longitudinally aligned magnetic key.

FIG. 17 is a sectional side elevational view of the handle 310 attached to the distal end of the tiller arm 300 with a rotating throttle knob 320 mounted on the end of the handle 310. Formed on the end of the knob 320 is a longitudinally aligned key slot 324 designed to receive a compatible shaped magnetic key 340. The key 340 includes a magnet 344 that is magnetically attracted to a reed switch 312 located in the handle 310. The key 340 is attached to a lanyard 346 and lanyard clamp 348 to attached the key to the tiller arm 300. Also attached to the lanyard 346 is an optional dead main lanyard 350. Also located in the handle 310 is a linear hall effect sensor 355.

Figure 18:
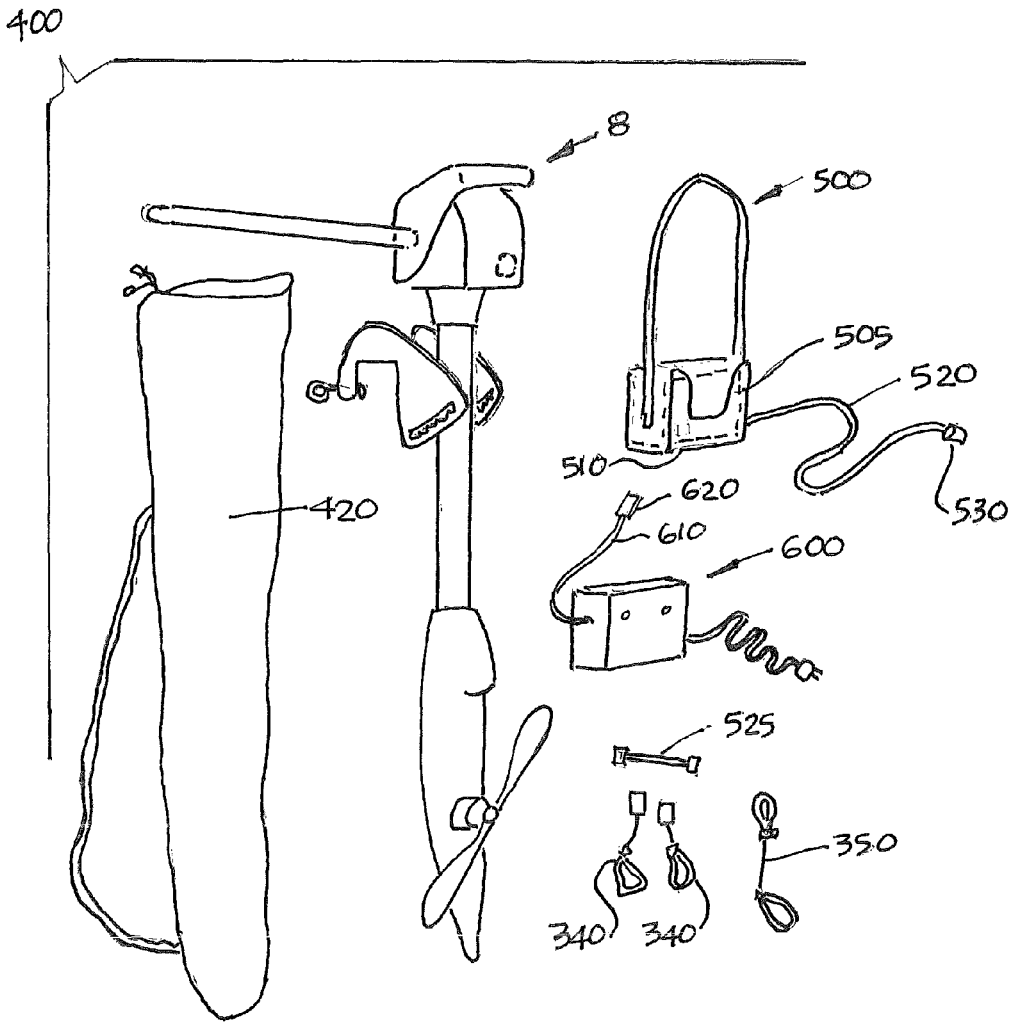
FIG. 18 is a perspective view of the electric motor assembly being distributed as a kit with a buoyancy battery case containing a 24 volt rechargeable battery, a standard 110 volt AC to 24 volt D.C. battery charger, a battery case transom mounting pin, two magnetic keys attached to lanyards, a dead man lanyard, and an electric motor assembly carrying case.

FIG. 18 is a perspective view of the electric motor assembly 8 being distributed as a kit 400 with a buoyancy battery case 500 containing the 24 volt rechargeable battery 550, a standard 110 volt AC to 24 volt D.C. battery charger 600, a battery case transom mounting pin 525, two magnetic keys 340 attached to lanyards, a dead man lanyard 350, and an electric motor assembly carrying case 420.

Figure 19:
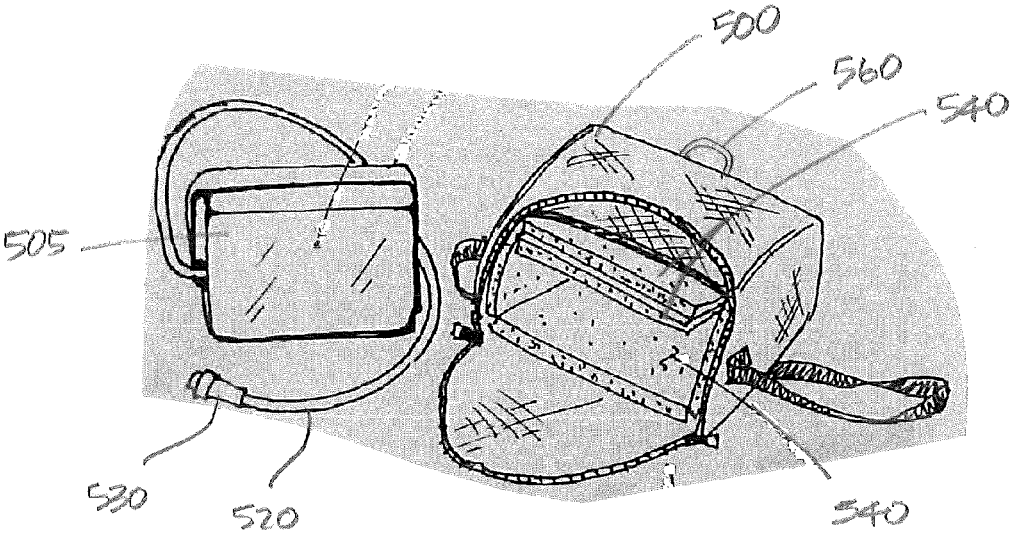
FIG. 19 is a perspective view of the rechargeable 24 volt battery with a connection line attached thereto with a waterproof connector and a water-proof bag used to hold the battery with foam located inside the bag to provide floatation.

FIG. 19 is a perspective view of the rechargeable 24 volt battery 505 with a connection line 530 attached thereto with a water-proof connector 50 connected at one end designed to connect to the plug connector on the side of the outer housing. The battery 505 is stored inside a water-proof bag 500 that contains several foam layers 540 that provide buoyancy n in the event the bag 540 is dropped in the water or thrown overboard. The bag 540 also includes a transom mount loop 560 through which a transom mount pin 525 is inserted to attach the bag 500 to the transom mount.

There are three functions in the handle of the tiller arm. The first function is the enable switch that is activated with a key. The key man also be coupled to a lanyard and act as a dead man switch. In the embodiment shown in the Figs. the key 330 magnetically acts on a reed switch 312 (or hall-effect switch) in the tip of the handle 310 as shown in the FIG. 17. The enable switch includes an o-ring seal 370 that prevents water intrusion. Sealing can be by the handle enclosure alone or it can also be potted for sealing. It should be understood that the key 330 could also be of a mechanical switch however magnetic operation is better suited to a marine environment as it is completely sealed against water. Also, in the embodiment shown in FIG. 17, and stated above, the key 330 is attached to a short loop lanyard 346 which is connected to the handle forming a loop into-which another loop of cord 350 can be threaded. This cord 350 can be attached to the operator so that in the event of a capsize, the cord loop pulls free the key from it's switch position thereby turning off the motor for safety. An important unique aspect of the location of the enable switch is in the handle 310 and within easy reach.

The second function of the handle 310 is that the throttle control is conveniently located for easy access. The throttle control is located on the outer surface of the handle 310 thereby leaving the inside portion of the handle free for steering and for raising and lowering the motor assembly without accidentally changing the throttle setting. The arrangement shown in FIG. 17 is also unique because it forms a linear hall-effect sensor that is acted upon by a magnet molded into the handle 310. The benefit of this arrangement is that the wires 30 leading from the handle 310 to the motor unit can be separated using electrical connectors so that an extension can be inserted for remote powering, thus making the motor easily re-configurable for various installations by the user.

A third function is the raising and lowering of the stem tube and the lower housing. Raising and lowering an outboard motor is traditionally accomplished by reaching to the rear of the upper housing, grasping the back or a handle component formed or attached to the motor housing and then pulling the entire motor assembly upward. Lowering the prior art entire assembly is accomplished by pushing on the motor housing, usually in accordance with releasing a latch also positioned far aft. On a small boats, this requires un-natural leaning and may upset the balance of the boat. The present invention dispenses with this approach by providing two enabling means. The first is to secure the motor in the down position and up position by means of a friction device that requires no manual latching or un-latching. The second is to provide a geometrical pivot point that enables the motor to be tilted by pulling on the tiller arm 300 and to be lowered by pushing on the tiller arm 300. The critical aspect of this means is that the distance from the motor pivot point to the pivot point of the tiller arm is between 4 and 7 inches, (5 inches being preferred), and that the angle from vertical of the motor pivot point to the pivot of the mount is approximately 45 degrees but may be as low as 30 degrees or as large as 60 degrees. When raised, the angle is reversed making the total change in angle to be approximately 90 degrees but it could be as much as 105 degrees or as little as 75 degrees.

The distance from the motor pivot point to the pivot point of the handle 310 is between 4 and 7 inches, with 5 inches being preferred. The desired distance is a function of weight of the motor being pivoted, a larger distance being required for heavier motors and a lower distance being necessary for lighter motors. Finally, the distribution of weight within the motor arrangement plays a role in this center-to center distance; When the motor is weighted more in the upper housing than the lower housing, the distance is reduced and when the motor is weighted in the lower unit, as is the case with pod-positioned electric motors, this center-to-center distance is increased to handle the extra torque needed in raising the motor.

In compliance with the statute, the invention described herein has been described in language more or less specific as to structural features. It should be understood however, that the invention is not limited to the specific features shown, since the means and construction shown is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. An outboard electric motor system for a small boat with a transom or a temporary transom plate attached thereto, said kit comprising:

a. an upper housing unit containing an electric motor;

c. an elongated, lower housing unit, extending downward from said upper housing unit, said lower housing unit includes a propeller assembly receiving cavity, said receiving cavity includes a propeller hub opening;

d. a drive shaft coupled to said electric motor and extending longitudinally through said lower housing unit and into said receiving cavity;

e. a main gear attached to the distal end of said drive shaft;

f. a fixed axle coaxially aligned and extended through said hub opening;

g. a rotating propeller hub mounted on said fixed axle, said propeller hub includes a body configured to cover hub opening, said propeller hub includes an outer neck that extends rearward from said lower housing, said hub also includes a longitudinally aligned center bore that enables said propeller hub to rotate freely around said fixed axle, h. a propeller perpendicularly aligned and attached to or formed on said propeller hub;

i. a secondary gear attached to or formed on said inside edge of said propeller hub said secondary gear also includes a center bore that enables said secondary gear to be coaxially mounted on said fixed axle, whereby when said secondary gear and said propeller hub are attached to said fixed axle, and said propeller hub is forced into said propeller receiving cavity, said main gear and said secondary gear are meshed together;

j. an adjustable transom mount attached to said upper housing unit, said transom mount attaches to said transom formed or attached to said small boat and, enables said upper housing to selectively rotated and swing forward over thetransom;

k. at least one tiller arm attached to said upper housing;

l. a rechargeable battery connected to said electric motor;

m. a switch means for activating and deactivating said electric motor; and, n. a switch means for controlling the RPMs of said electric motor.

2. The outboard electric motor system, as recited in claim 1, further including means for connecting said battery to said transom mount.

3. The outboard electric motor system, as recited in claim 2, wherein said means for connecting said battery to said transom mount is at least one loop attached to said battery, a plurality of holes formed on said transom mount and a removable pin that extends through said loop and said holes to securely attach said battery to said transom mount.

4. The outboard electric motor system, as recited in claim 2, wherein said battery is watertight and sufficiently buoyant to float in water.

5. The outboard electric motor system, as recited in claim 1, wherein said battery is watertight and sufficiently buoyant to float in water.

6. The outboard electric motor system, as recited in claim 1, wherein said switch means for activating and deactivating said motor unit is located on said tiller arm.

7. The outboard electric motor system, as recited in claim 6, wherein said switch means for controlling the RPM's of said motor unit is located on said tiller arm.

8. The outboard electric motor system, as recited in claim 1, wherein said switch means for controlling the RPM's of said motor unit is located on said tiller arm.

9. The outboard electric motor system, as recited in claim 6, wherein said switch means for controlling the RPM's of said motor unit is located on said tiller arm.

10. The outboard electric motor system, as recited in claim 1, further including and automatic shut off switch that automatically deactivates the motor unit when a user's hand is removed from said tiller arm.

11. The outboard electric motor system, as recited in claim 7, wherein said automatic shut off switch is a magnetic key that fits into said key slot formed on the end of said tiller arm, said magnetic key being attached to a wrist band.

12. The outboard electric motor system, as recited in claim 1, further including a battery recharger.

13. An electric outboard motor system, comprising:

a. an electric rotary motor, main drive shaft, a metallic main gear, a fixed non-rotating propeller shaft, and a replaceable module that includes a plastic secondary gear, a hub, a bearing and a propeller, said module configured so that when mounted on said propeller shaft said secondary gear meshes with said drive gear, said secondary gear contain:

between 2 and 4 times more teeth than said main gear; and a means for retaining said module on said propeller shaft; and, a protective housing that surrounds said drive gear and said secondary gear and allow water to enter said protective housing and surround said drive gear and said secondary gear when submerged in water.

14. The system of claim 13, wherein said main drive shaft and motor shaft are made from one piece of material.

15. The system of claim 13, wherein said main drive shaft includes a distal end with a removable block configured to hold and support said main gear in a fixed position to mesh with said secondary gear when module is attached to said propeller shaft.

16. The system of claim 13, further including a waterproof battery is contained in a bag with buoyant material that allows said bag containing said battery to float.

17. The system of claim 16 wherein said buoyant material is closed-cell foam.

18. The system of claim 13, further including a motor clamp for mounting said electric rotary motor to a transom and further including said battery is removably fixed to said motor mount clamp.

19. The system of claim 18, wherein said battery is attached to said motor clamp with a removal pin.

* * * * *